US007520203B2

(12) United States Patent
An

(10) Patent No.: US 7,520,203 B2
(45) Date of Patent: Apr. 21, 2009

(54) APPARATUS FOR REMOVING DUD

(75) Inventor: Sang Jin An, Ulsan (KR)

(73) Assignee: Soosung Machinery Co., Ltd., Ulsan (KR)

( * ) Notice: Subject to any disclaimer, the term of this patent is extended or adjusted under 35 U.S.C. 154(b) by 216 days.

(21) Appl. No.: 11/509,514

(22) Filed: Aug. 24, 2006

(65) Prior Publication Data

US 2007/0240561 A1 Oct. 18, 2007

(30) Foreign Application Priority Data

Apr. 12, 2006 (KR) ..... 10-2006-0033031

(51) Int. Cl.
*B64D 1/04* (2006.01)
*F41C 7/00* (2006.01)
*F41A 15/00* (2006.01)

(52) U.S. Cl. ..... 89/1.3; 89/1.4; 42/51; 42/55; 42/90; 42/106

(58) Field of Classification Search ..... 42/90, 42/55, 106, 51; 89/1.3, 1.4
See application file for complete search history.

(56) References Cited

U.S. PATENT DOCUMENTS 3,680,242 A * 8/1972 Wiese ..... 42/25
4,494,440 A * 1/1985 Koine ..... 89/33.04
5,691,497 A * 11/1997 Weichert et al. ..... 89/1.4
7,073,286 B2 * 7/2006 Paananen et al. ..... 42/95
7,165,351 B2 * 1/2007 Church ..... 42/51
7,257,917 B1 * 8/2007 Garland ..... 42/51
7,356,961 B2 * 4/2008 Williams ..... 42/95
2004/0074523 A1 * 4/2004 Paananen et al. ..... 134/22.12
2005/0188598 A1 * 9/2005 Paananen et al. ..... 42/95
2006/0162218 A1 * 7/2006 Church ..... 42/51
2006/0236584 A1 * 10/2006 Williams ..... 42/95
2006/0277811 A1 * 12/2006 Peterson ..... 42/95
2007/0051028 A1 * 3/2007 Stordal ..... 42/95
2007/0084336 A1 * 4/2007 Neves ..... 89/1.3
2007/0240353 A1 * 10/2007 An ..... 42/95
2007/0294930 A1 * 12/2007 Mays ..... 42/95
2008/0005952 A1 * 1/2008 Sutherby ..... 42/90
2008/0016747 A1 * 1/2008 Binek et al. ..... 42/95

* cited by examiner

*Primary Examiner*—Bret Hayes
*Assistant Examiner*—Michael D David
(74) *Attorney, Agent, or Firm*—Ladas and Parry LLP

(57) ABSTRACT

An apparatus for removing a dud is disclosed, which makes it possible to safely remove a dud from various kinds of guns used as long-range firepower when a shell is caught in the inner diameter of a gun barrel and thus is not discharged. The apparatus includes a forward driving means providing a propulsive force for forwarding the apparatus along an inner surface of a gun barrel, a press driving part directly connected to the forward driving means and having a built-in motor to provide a rotating force, a sticking means connected to the press driving part and extended to an outside to be tightly stuck on the inner surface of the gun barrel by a main shaft being rotated by the motor, and a pushing part having one end part connected to the sticking means and the other end part coupled to a cap that is in contact with the dud, and pushing the cap through a forward movement of the main shaft after the sticking on the inner surface of the gun barrel is performed by the sticking means.

15 Claims, 4 Drawing Sheets

APPARATUS FOR REMOVING DUD

CROSS-REFERENCE TO RELATED APPLICATION

This application is based on and claims priority from Korean Patent Application No. 10-2006-0033031, filed on Apr. 12, 2006 in the Korean Intellectual Property Office, the disclosure of which is incorporated herein in its entirety by reference.

BACKGROUND OF THE INVENTION

1. Field of the Invention

The present invention relates to an apparatus for removing a dud, and more particularly to an apparatus for removing a dud, which makes it possible to safely remove a dud from various kinds of guns used as long-range firepower when a shell is caught in the inner diameter of a gun barrel and thus is not discharged.

2. Description of the Prior Art

A dud is very unstable, and thus an explosion accident may occur when a person attempts to remove the dud from a gun by force. Since there is no suitable dud removing device in spite of such a burden of risk, duds have been manually removed from guns.

In order to solve this problem, Korean Patent Registration No. 0459080 applied by and granted to the applicant discloses a dud removing apparatus.

FIG. 1 is a sectional view explaining the operation of a conventional dud removing apparatus. This conventional dud removing apparatus includes a shell cap 100 inserted into the inner diameter of a gun barrel and formed to correspond to the shape of a front part of a shell to sense a dud 4, a forward driving means 200 formed to forward the shell cap 100 to a shell sensing position and then to automatically come to a standstill, and a forward pressing means 300 installed in the rear of the shell cap 100 to pressurize the shell cap through the forward movement of a lead part 340.

A process of removing a dud that is performed by the above-described conventional apparatus will now be explained. If a dud 4 exists in a gun, the dud removing apparatus is pushed into a gun barrel, and is moved forward by the forward driving means 200 until the shell cap 100 reaches the dud 4. When it is sensed that the shell cap 100 reaches the dud 4, the forward driving means 200 comes to a standstill, and then the forward pressing means 300 operates.

In the forward pressing means 300, a first case 310 and a pressing member 343 are screw-engaged with each other, and a second case 320 is connected to a rear part of the first case via a buffer member 321. A shaft receptacle 342 and a rear surface of the second case 320 are elastically coupled to each other.

By the above-described structure, the connection parts of the first case 310 and the second case 320 primarily become in tight contact with each other by the elastic coupling of the shaft receptacle 342 and the second case 320, and the buffer member 321 is compressed to increase a frictional force between the first case and the second case, so that the first case 310 can be prevented from being rotated by the rotating force of the pressing member 343.

Since the rotation of the first case 310 is prevented, the pressing member 343 is moved forward to push the shell cap 100, and thus the dud 4 is removed from the gun barrel.

In order to remove the dud caught in the gun barrel, only the pressing member should be moved forward to push the dud in a state the dud removing apparatus is stuck on the inner surface of the gun barrel. In other words, the dud removing apparatus should not make a backward movement during the dud removing process.

However, the conventional dud removing apparatus has the problem that it is not provided with any means for tightly sticking the dud removing apparatus on the inner surface of the gun barrel.

That is, the sticking of the dud removing apparatus on the inner surface of the gun barrel is performed by only guide rollers 311*b* and 241, which rotate to make the dud removing apparatus move forward, but cannot provide a sticking force enough to prevent the backward movement of the dud removing apparatus during the dud removing process.

Consequently, the conventional dud removing apparatus cannot remove the dud smoothly and promptly.

SUMMARY OF THE INVENTION

Accordingly, the present invention has been made to solve the above-mentioned problems occurring in the prior art, and an object of the present invention is to provide an apparatus for removing a dud that is provided with a sticking means that can tightly stick the dud removing apparatus on the inner surface of a gun barrel before the dud is removed in order to provide the dud removing apparatus having a superior performance.

Another object of the present invention is to provide an apparatus for removing a dud that has a mechanism for performing a dud removing work after the dud removing apparatus is stuck on the inner surface of a gun barrel and thus can remove the dud efficiently and stably.

In order to accomplish these objects, there is provided an apparatus for removing a dud, provided with a forward driving means providing a propulsive force for forwarding the apparatus along an inner surface of a gun barrel, according to the present invention, which includes a press driving part directly connected to the forward driving means and having a built-in motor to provide a rotating force, a sticking means connected to the press driving part and extended to an outside to be tightly stuck on the inner surface of the gun barrel by a main shaft being rotated by the motor, and a pushing part having one end part connected to the sticking means and the other end part coupled to a cap for contacting with the dud, and pushing the cap through a forward movement of the main shaft after the sticking on the inner surface of the gun barrel is performed by the sticking means.

The main shaft may be composed of a large end part and a small end part having different diameters and screw threads formed on their outer surfaces, and the large end part may be connected to an output shaft of the motor for the main shaft to make a rectilineal movement in a direction of the main shaft.

The sticking means may include a first flange coupled to the outer surface of the large end part, a slide covering the outer surface of the first flange, bound by a rotation preventing pin, and having an edge part that forms an inclined surface, and an extender having an inner surface that forms a sloping surface corresponding to the inclined surface and extending to an outside to be stuck on the inner surface of the gun barrel as the slide is moved backward.

The rotation preventing pin may have a coupling part that forms a long slot to which the first flange is coupled, whereby only the first flange is moved backward after the slide is moved backward for a predetermined distance and the extender is stuck on the inner surface of the gun barrel.

On one side of the outer surface of the first flange, appearing and disappearing steel balls that are in contact with the slide are installed. The extender may be composed of upper and lower pads having connection surfaces that form square prominence and depression, and the lower pad may be moved forward for one pitch of the square prominence and depression.

The pushing part may include a holder one side of which is connected to the sticking part, the cap one end of which is coupled to the other side of the holder and supported by a spring to make a rectilineal movement in the direction of the shaft, and a second flange formed inside the holder and screw-engaged with the small end part of the main shaft to transfer the rotating force of the main shaft.

The pushing part may include a first sensor sensing the maximum distance of the backward movement of the cap supported by the spring, and a rotating plate sensing sensor recognizing a rotating plate coupled to the small end part of the main shaft and controlling the maximum distances of the forward and backward movements of the main shaft. The cap may be provided with a pressing rotor being in contact with the end part of the main shaft connected to the holder to be rotated with the main shaft.

The apparatus for removing a dud according to the present invention may further include a plurality of centering balls that are in contact with the inner surface of the gun barrel to center the apparatus.

The forward driving means may further include a plurality of wheels that are in contact with the inner surface of the gun barrel, a forward movement motor providing power to the wheels, and a fastening part fastening the forward driving means to the end part of the press driving means.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Hereinafter, preferred embodiments of the present invention will be described with reference to the accompanying drawings. The matters defined in the description, such as the detailed construction and elements, are nothing but specific details provided to assist those of ordinary skill in the art in a comprehensive understanding of the invention, and thus the present invention is not limited thereto.

The construction and operation of an apparatus for removing a dud according to the present invention will now be described in detail with reference to preferred embodiments.

An apparatus for removing a dud according to an embodiment of the present invention basically includes a forward driving means, a press driving part, a sticking means, and a pushing part. The forward driving means is a part that provides a basic propulsive force for forwarding the dud removing apparatus in a gun barrel. Since this forward driving means is used only to provide the propulsive force, diverse modifications thereof are possible. Detailed construction and operation of the forward driving means will be explained later.

By the operation of the forward driving means, the dud removing apparatus is moved forward along the inner surface of the gun barrel, and the operation of the forward driving means is stopped in accordance with a sensed signal from a sensor. Then, the press driving part is driven to operate the sticking means, so that the dud removing apparatus is stuck on the inner surface of the gun barrel. After the apparatus is stuck on the inner surface of the gun barrel by the sticking means, the removal of the dud is performed by the pushing part.

Hereinafter, detailed constituent elements of the dud removing apparatus according to the present invention, their connections and operations will be explained with reference to the accompanying drawings.

Figure 1:
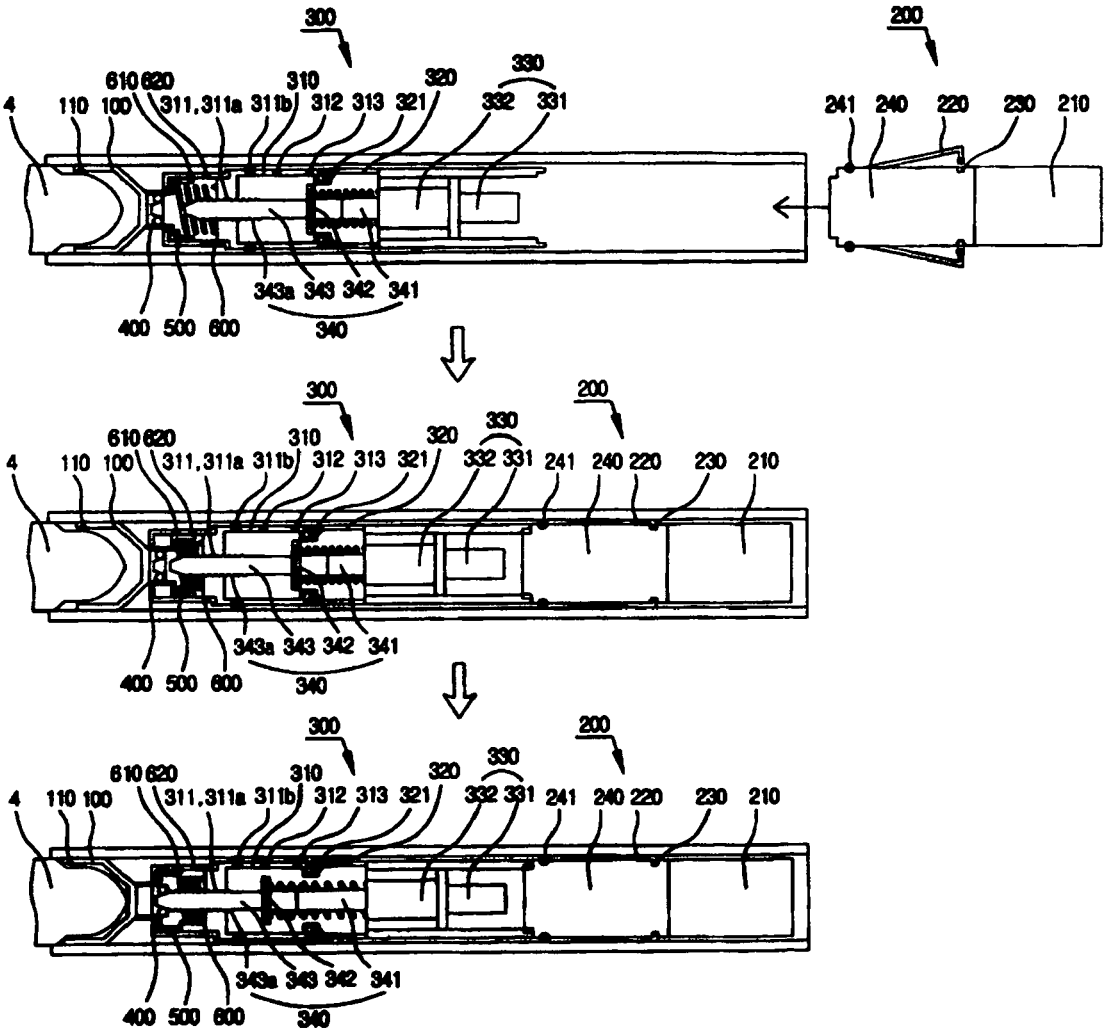
Fig. 1 Prior Art
FIG. 1 is a sectional view explaining the operation of a conventional dud removing apparatus.
Figure 2:
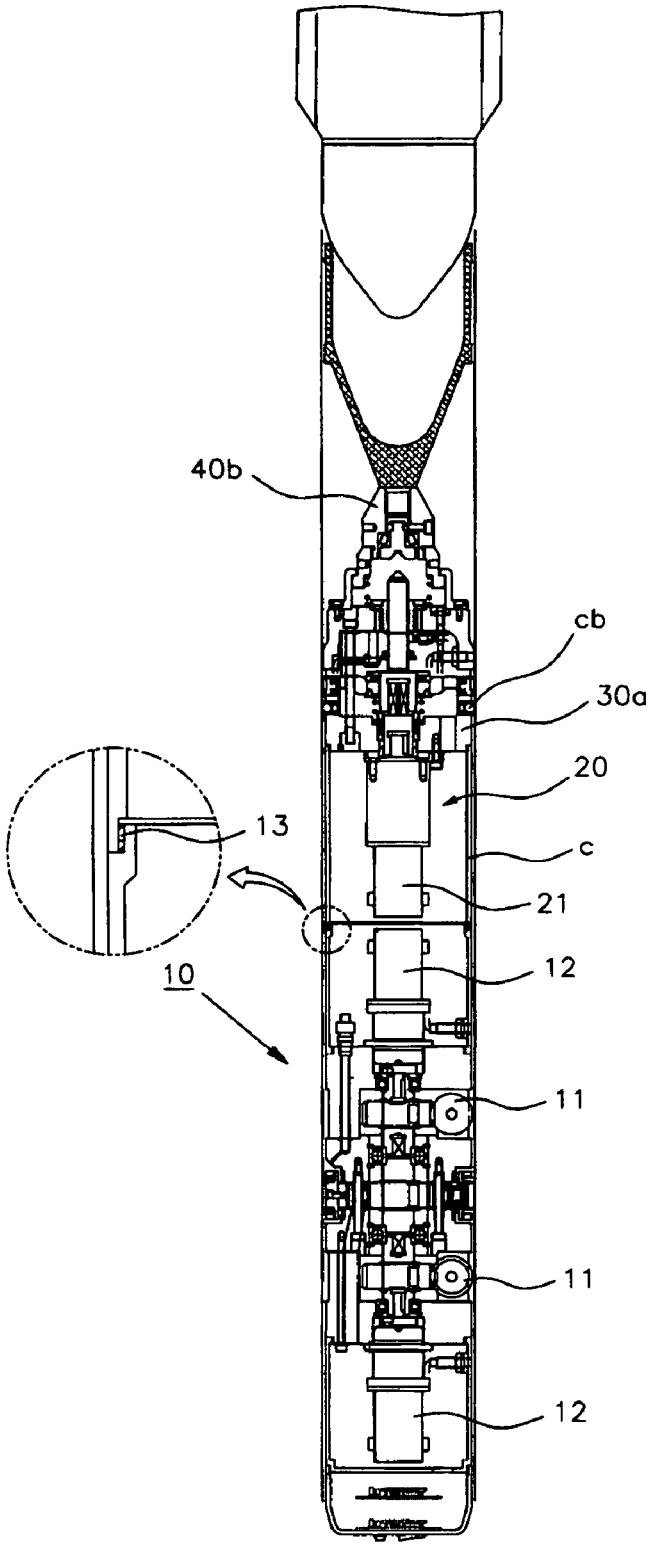
FIG. 2 is a sectional view illustrating the whole construction of an apparatus for removing a dud according to an embodiment of the present invention.
Figure 3:
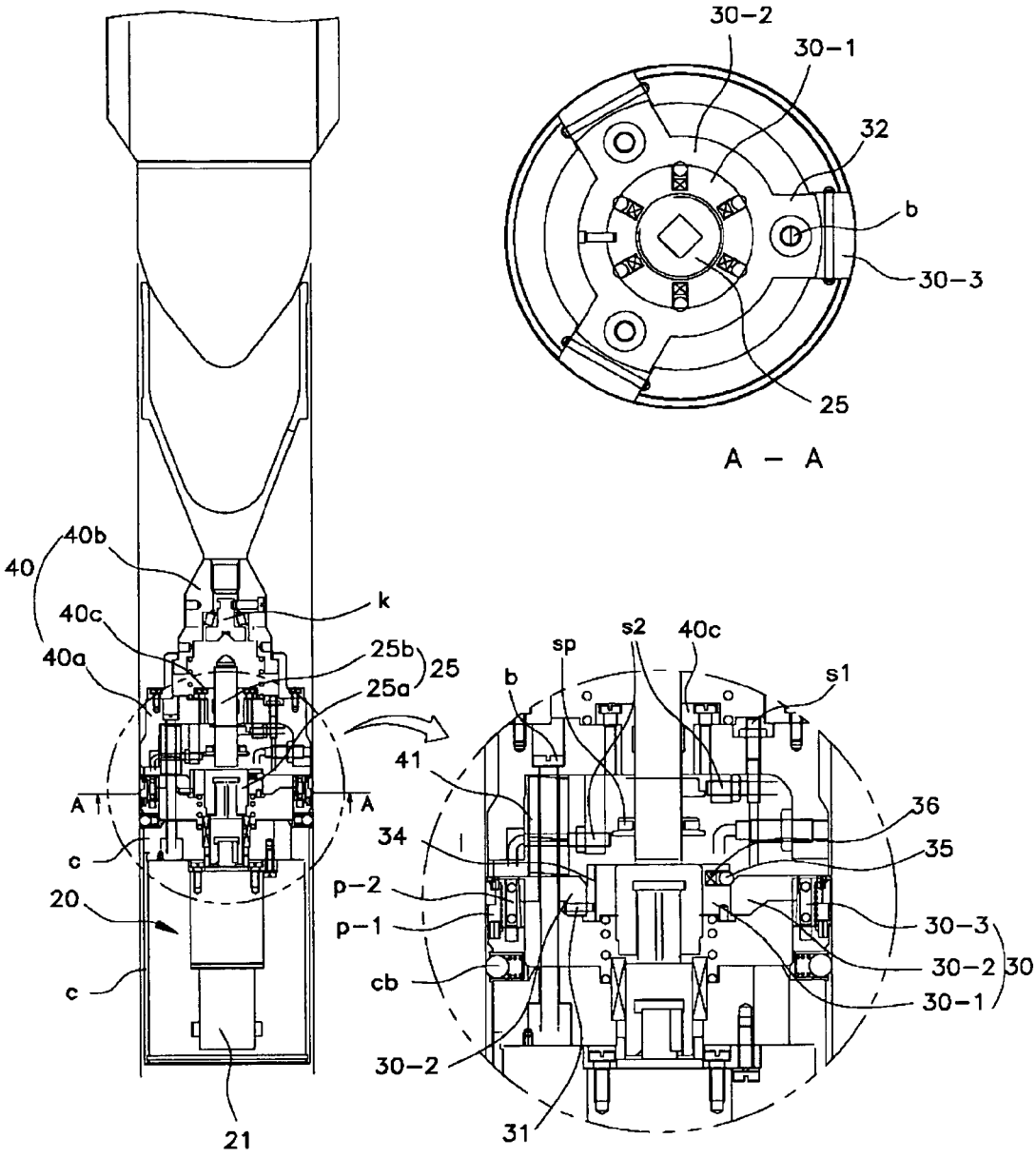
FIG. 3 is an enlarged sectional view of a sticking part and a pushing part in a state that a forward driving means is eliminated.

FIG. 2 is a sectional view illustrating the whole construction of an apparatus for removing a dud according to an embodiment of the present invention, and FIG. 3 is an enlarged sectional view of a sticking part and a pushing part of the apparatus in a state that a forward driving means is eliminated.

Referring to FIG. 2, a press driving part 20 is connected to one side of a forward driving means 10, and a motor 21 is built in the press driving part 20 to provide a rotating force. A reduction gear is connected to the motor, and the output shaft of the motor is coupled to a main shaft 25. The press driving part 20 has a cylindrical cover c in which the motor and the reduction gear are arranged.

A sticking means 30 is provided in front of the press driving part 20. Preferably, a connector 30*a* may be interposed between the press driving unit 20 and the sticking means 30 to be used for fixing the motor 21. The structure of the connector 30*a* may be changed in diverse forms, and may be a part of the press driving part 20 if needed.

As illustrated in FIG. 2, it is preferable that a plurality of centering balls cb may be provided in a circle on an outer side of the connector. The centering balls cb are arranged at the same interval, and prevent the front part of the dud removing apparatus from drooping inside a gun barrel.

The centering balls are supported by springs and are projected enough to be in contact with the inner surface of the gun barrel.

The sticking means 30 is provided with a first flange 30-1, a slide 30-2, and an extender 30-3. Before the detailed explanation of the sticking means, the main shaft 25 that is connected to the output shaft of the press driving part 20 and is associated with the sticking means 30 and a pushing part 40 will be explained.

As shown in the drawing, the main shaft 25 is composed of a large end part 25*a* and a small end part 25*b* having different diameters, and the end of the small end part is in the form of a cone. Screw threads are formed on outer surfaces of the large end part 25*a* and the small end part 25*b*, and the large end part 25*a* is connected to the output shaft of the motor 21. In particular, the main shaft 25 is basically rotated together with the output shaft of the motor 21, and if a condition is satisfied, it makes a rectilineal movement in a direction of the shaft.

In the sticking means 30, the first flange 30-1 is coupled to the outer surface of the large end part 25*a* of the main shaft 25. The first flange 30-1 and the large end part 25*a* of the main shaft 25 are screw-engaged with each other to form a circle. On the outer surface of the first flange 30-1, the slide 30-2 is connected. The slide 30-2 is inserted into and becomes in surface contact with the first flange 30-1, and is bound to the first flange 30-1 by a rotation preventing pin 31.

By the rotation preventing pin 31, the first flange 30-1 is prevented from being rotated, and as the main shaft 25 is rotated under this condition, the first flange 30-1 and the slide 30-2 make a rectilineal movement in the backward direction. The edge part of the slide 30-2 forms a slanted surface.

In particular, with reference to the sectional view along A-A line of FIG. 3, the slide 30-2 has three projected ribs 32 formed at an angle of 120 degrees. A fastening bolt b penetrates the slanted surface formed on the end part of each rib.

On the outer side of the slide 30-2, the extender 30-3 is formed, and a slope surface of the extender is in contact with the slanted surface of the rib 32. As the slide 30-2 is moved backward, the extender 30-3 is gradually moved outward to be stuck on the inner surface of the gun barrel. In order to make the extender 30-3 move, the slide can be bound to the first flange by a pin, and thus the detailed explanation thereof will be omitted.

Preferably, the extender 30-3 may be composed of upper and lower pads p-1 and p-2, and their connection surfaces form square prominence and depression. By providing such prominence and depression, the extender is movable as much as the height of the prominence and depression. The reason why the extender 30-3 is divided into the upper pad p-1 and the lower pad p-2 is to separate the extender 30-3 from the inner surface of the gun barrel if the extender is tightly stuck on the inner surface of the gun barrel due to an improper operation of the motor during the performing of the dud removing process.

Figure 4:
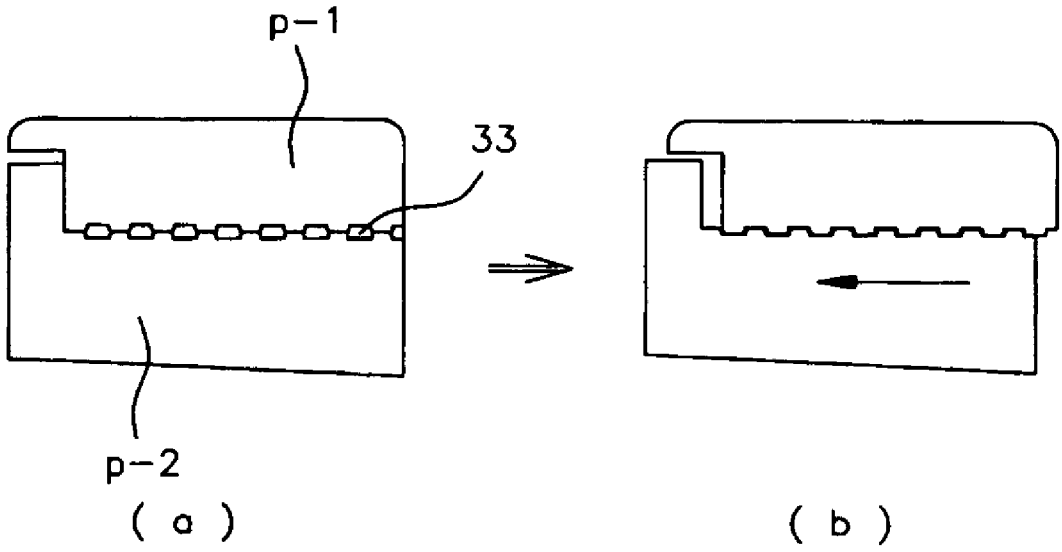
FIGS. 4*a* and 4*b* are exemplary views illustrating the changed states of an extender.

FIGS. 4*a* and 4*b* are exemplary views illustrating the changed states of an extender. Specifically, FIG. 4*a* shows a state that the upper pad p-1 is completely stuck on the inner surface of the gun barrel, and the prominence and depression grooves 33 of the upper pad p-1 and the lower pad p-2 are not engaged with one another. In order to move the dud removing apparatus forward or backward in this state, the extender (i.e., the upper pad) being stuck on the inner surface of the gun barrel should be moved inward.

In order to move the extender 30-3 inward in a normal state, it is required to forward the retreated slide 30-2 in an opposite direction. That is, if the slide 30-2 is moved forward, the extender 30-3 having the slope contact surface comes inward. However, in the event that the slide cannot be moved forward due to the trouble of the motor 21 and so on, the dud removing apparatus may be pushed in a direction indicated by an arrow. In this case, the lower pad p-2 is moved forward against the fixed upper pad p-1 to make the prominence and depression grooves 33 engaged with one another, and this causes the upper pad p-1 to be moved inward as much as the depth of the prominence and depression grooves 33 and to be apart from the inner surface of the gun barrel, so that the sticking state of the extender is released.

On the other hand, a straight slot 34 is formed on the first flange 30-1 into which the rotation preventing pin 31 is inserted, and a plurality of steel balls 35 are provided on the outer surface of the first flange 30-1. As shown in FIG. 3, the steel balls 35 are supported by the slide 30-2 without seceding, and are movable up and down by the support of a cushion body. As illustrated in FIG. 3, the steel balls 35 are in contact with one end part of the slide 30-2, and their contact surfaces are filleted.

The operation of the slide 30-2 and the first flange 30-1 provided with the rotation preventing pin 31 and the steel balls 35 will now be explained. As the main shaft 25 is rotated, both the first flange 30-1 and the slide 30-2 are moved backward. In the embodiment of the present invention, the amount of backward movement is set to 5 mm, and when the first flange 30-1 and the slide 30-2 are moved backward by 5 mm, the extender 30-3 becomes in tight contact with the inner surface of the gun barrel.

Since the steel balls 35 support the slide 30-2 until the first flange 30-1 and the slide 30-2 are moved by 5 mm, both the first flange 30-1 and the slide 30-2 are moved backward, and when the moving distance exceeds 5 mm, only the first flange 30-1 is moved backward.

Specifically, as the extender 30-3 is completely stuck on the inner surface of the gun barrel, a further load occurs, and thus the steel balls 35 supporting the slide 30-2 descend and go down the slide 30-2 to cause only the first flange 30-1 to be moved backward. In this case, since the rotation preventing pin 31 has been inserted into the slot 34, only the first flange 30-1 is moved backward.

One end part of the pushing part 40 is connected to the sticking means 30, and the other part thereof is coupled to a cap 40*b*. After the extender 30-3 of the sticking means 30 is stuck on the inner surface of the gun barrel, the cap 40*b*, which is a part that is in direct contact with the dud, is pushed to reach the dud 4 by the forward movement of the main shaft 25.

The pushing part 40 includes a holder 40*a*, the cap 40*b* and a second flange 40*c*. In the embodiment of the present invention, the holder 40*a* is hollowed, and its diameter is gradually decreased from its side facing the sticking means 30 to its end part connected to the cap.

As illustrated in the drawing, the holder 40*a* is arranged in succession to the sticking means 30, and is fastened to the slide 30-2 by a fastening bolt b penetrating the slide 30-2.

Specifically, by the fastening bolt b, the holder 40*a*, the slide 30-2 and a connector 30*a* are connected together, and an elastic body 41 is interposed between the holder 40*a* and the slide 30-2. A general spring can be used as the elastic body 41, and it is preferable that the elastic body is put on the fastening bolt.

One end part of the cap 40*b* is bound to the holder 40*a*, and the other end part thereof is empty so as to accommodate a head part of the dud. The end part of the cap 40*b* that is in contact with the dud is in the form of a circle so that it can press the dud.

The connection part of the holder 40*a* and the cap 40*b* is prevented from seceding from the holder 40*a* by the end part of the cap 40*b*, and a spring s is installed so that the cap 40*b* can be moved in a prescribed distance range against the holder 40*a*.

Also, in the center part of the cap 40*b* connected to the holder 40*a*, a pressing rotor k that is in contact with the main shaft 25 and receives force from the main shaft 25 is installed. In the embodiment of the present invention, the pressing rotor k is rotatably supported by a tapered bearing, and its part that is in contact with the main shaft is concave in the same manner as the end part of the main shaft.

As the main shaft 25 is rotated and is moved forward, the end part of the main shaft becomes in contact with the pressing rotor k and gradually pushes the cap 40*b*. Here, the pressing rotor k serves to transfer the force of the main shaft as it is rotated in a state that it is in contact with the main shaft.

On the other hand, the second flange 40*c* is installed inside the holder 40*a*. As shown in the drawing, the second flange 40*c* is screw-engaged with the small end part of the main shaft 25. Accordingly, if the main shaft 25 is rotated, the holder 40*a* is not rotated, but is moved backward.

The holder 40*a* is moved backward simultaneously with the backward movement of the first flange 30-1 and the slice 30-2. This backward movement of the holder 40*a* continues until the holder becomes in contact with the sticking means 30. In the embodiment of the present invention, the first flange 30-1 and the slide 30-2 are moved backward by 5 mm, and thereafter, only the first flange 30-1 is moved backward until the holder 40*a* reaches the sticking means.

In the embodiment of the present invention, the distance of the backward movement of the holder 40*a* is set to 6 mm, and accordingly, the maximum distance of backward movement of the first flange 30-1 becomes 6 mm. That is, both the first flange 30-1 and the slide 30-2 are moved backward by 5 mm, and then only the first flange 30-1 is moved backward by 1 mm.

As described above, when the backward movement of the holder 40*a* becomes impossible according to the rotation of the main shaft 25, the main shaft 25 makes a rectilineal movement. As the main shaft 25 is move forward, it pushes the cap 40*b* to remove the dud 4.

In constructing the pushing part 40, it is preferable to install a plurality of sensors in the holder 40*a*. By using such sensors, the driving of the motor, change of the rotating direction, and stop of rotation can be automatically controlled. Since the providing of a control part for an automatic control of the dud removing apparatus in association with the sensors is well known in the art, detailed explanation thereof will be omitted. Now, the function and operation of the sensors according to the present invention will be explained.

In the holder 40*a*, a first sensor s1 and a rotating plate sensing sensor s2 are provided. The first sensor s1 is in contact with the end part of the cap supported by the spring, and senses the maximum distance of the backward movement of the cap. The dud removing apparatus according to the present invention is inserted into the gun barrel and is moved forward to reach the dud by the operation of the forward driving means.

If the end part of the cap 40*b* becomes in contact with the dud, the forward movement of the apparatus continues until the first sensor s1 senses the other end part of the cap 40*b*. Once the cap 40*b* is in contact with the dud, the cap 40*b* is supported by the spring, and thus the remaining parts including the holder 40*a* are moved forward in a state that the cap 40*b* is fixed.

In the embodiment of the present invention, the maximum distance of the backward movement of the cap 40*b* is set to about 15 mm, and when the first sensor s1 outputs a sensed signal, the motor 21 provided in the forward driving means 10 is stopped by the sensed signal.

In the embodiment of the present invention, two rotating plate sensing sensors S2 are provided, and the rotating plate sp is coupled to the small end part 25*b* of the main shaft 25. The rotating plate sensing sensors s2 are installed to be apart from each other, and determine the maximum distance of the forward movement and the maximum distance of the backward movement of the main shaft 25 by recognizing the rotating plate sp.

As shown in the drawing, before the main shaft 25 is moved forward, the rotating plate sp is located to correspond to one rotating plate sensing sensor s2 located in front, and if the rotating plate is located to correspond to the other rotating plate sensing sensor s2 by the forward movement of the main shaft 25, the motor 21 of the press driving part 20 that rotates the main shaft 25 is stopped. When the main shaft 25 is move backward, the motor 21 rotates in a reverse direction.

Hereinafter, the forward driving means 10 according to an embodiment of the present invention will be explained.

The forward driving means 10 is connected to the rear end of the press driving part 20, and provides a propulsive force for moving the dud removing apparatus forward in the gun barrel. The forward driving means includes a plurality of wheels 11, a forward movement motor 12 providing power to the wheels, and a fastening part 13 fastening the forward driving means to the press driving part 20.

In the embodiment of the present invention, three front wheels and three rear wheels are provided as the wheels 11, and the three wheels are arranged at the same interval so that they can stably contact the inner surface of the gun barrel. The front wheels and the rear wheels receive power from the forward movement motor 12, and the three wheels are connected to worm gears connected to the forward movement motor. In the embodiment of the present invention, two forward movement motors are provided to provide great power.

Of course, one forward movement motor 12 may be provided, and the type of the motor may be properly selected. Basically, the forward movement motor 12 may be implemented by a DC motor or an AC motor.

Since the forward driving means 10 is used only to move along the inner surface of the gun barrel, it will be apparent that diverse modifications thereof are possible in addition to those applied according to the embodiments of the present invention, and such modifications having the same function are within the scope of the present invention.

On one side of the forward driving means 10, the fastening part 13 for connecting to the press driving part 20 is provided. The fastening part 13 is provided with corresponding grooves to facilitate the fastening and disconnecting operation. Diverse types of fastening parts are well known in the art.

In particular, the forward driving means 10 can be used as a device capable of washing the gun barrel, and in this case, a brush may be mounted thereon if needed. The brush may be eliminated in the case of using the forward driving means as a means for providing a propulsive force to the dud removing apparatus.

As described above, the forward driving means 10 is used only to move along the inner surface of the gun barrel, and thus the forward driving means as illustrated in the accompanying drawings is merely exemplary.

Hereinafter, the whole operation of the dud removing apparatus according to an embodiment of the present invention will be explained.

If a dud 4 exists in a gun barrel, the dud removing apparatus is pushed into the gun barrel, and the forward driving means 10 is operated. In order to control the forward driving means 10 automatically, sensors sensing the gun barrel are installed to drive the forward movement motor 12. If the forward driving means 10 is operated, the wheels are rotated, being in contact with the inner surface of the gun barrel, and thus the dud removing apparatus is gradually moved forward.

If the cap 40*b* becomes in contact with the dud by the forward movement of the dud removing apparatus, the forward movement motor 12 of the forward driving means 10 is operated until the first sensor s1 senses this. If a sensed signal of the first sensor s1 is applied, the forward movement motor 12 is stopped, and then the motor 21 of the press driving part 20 is operated. If the motor 21 of the press driving part 20 is operated, the main shaft 25 is rotated, and thus the sticking means 30 and the pushing part 40 are moved backward.

Specifically, the first flange 30-1 and the slide 30-2 connected to the large end part 25*a* of the main shaft 25 are moved backward by a prescribed distance (e.g., 5 mm), and simultaneously, the extender 30-3 that is in contact with the slide 30-2 is move outward to be stuck on the inner surface of the gun barrel.

At this time, the pushing part 40 is also moved backward until the holder 40*a* reaches the sticking means 30. In the embodiment of the present invention, the distance of the backward movement is set to 6 mm. Both the first flange 30-1 and the slide 30-2 are moved backward by 5 mm, and then only the first flange 30-1 is moved backward by 1 mm.

The backward movement of the first flange only has been described.

If the holder 40*a* is moved backward by 6 mm and thus there is no space for the backward movement, the rotation is stopped, and only the main shaft 25 is rotated and is moved forward by the non-movable sticking means 30 and the pushing part 40. As the main shaft 25 is moved forward, the end part of the main shaft pushes the pressing rotor k, and thus the cap 40*b* is gradually moved forward to push the dud 4. The maximum forward movement distance of the cap 40*b* at a time is limited, and in the embodiment of the present invention, it is set to about 15 mm. If the dud is not removed at once, the same dud removing operation should be performed several times.

As described above, according to the present invention, an actual dud removing work is performed after the dud removing apparatus is stuck on the inner surface of the gun barrel by a sticking means, and thus the dud removing apparatus is not pushed back during the dud removing work, so that the dud can be removed more effectively.

In addition, since the dud removing process is promptly performed, duties can be performed without fail even in a state of emergency such as in war.

Although preferred embodiments of the present invention have been described for illustrative purposes, those skilled in the art will appreciate that various modifications, additions and substitutions are possible, without departing from the scope and spirit of the invention as disclosed in the accompanying claims.

The invention claimed is:

1. An apparatus for removing a dud, provided with a forward driving means providing a propulsive force for forwarding the apparatus along an inner surface of a gun barrel, the apparatus comprising:

a press driving part directly connected to the forward driving means and having a built-in motor to provide a rotating force;

a sticking means for extension to provide a sticking force on the inner surface of the gun barrel upon rotation of a main shaft by the motor to prevent backward movement of the apparatus during dud removal, said sticking means being connected to the press driving part; and a pushing part having one end part connected to the sticking means and the other end part coupled to a cap for contacting the dud, and pushing the cap through a forward movement of the main shaft after the sticking on the inner surface of the gun barrel is performed by the sticking means.

2. The apparatus of claim 1, wherein the pushing part comprises:

a holder one side of which is connected to the sticking part;

the cap one end of which is coupled to the other side of the holder and supported by a spring to make a rectilineal movement in the direction of the shaft; and a second flange formed inside the holder and screw-engaged with the small end part of the main shaft to transfer the rotating force of the main shaft.

3. The apparatus of claim 2, wherein the pushing part comprises:

a first sensor sensing the maximum distance of the backward movement of the cap supported by the spring; and a rotating plate sensor recognizing a rotating plate coupled to the small end part of the main shaft and controlling the maximum distances of the forward and backward movements of the main shaft.

4. The apparatus of claim 2, wherein the cap is provided with a pressing rotor being in contact with the end part of the main shaft connected to the holder to be rotated with the main shaft.

5. The apparatus of claim 1, further comprising a plurality of centering balls that are in contact with the inner surface of the gun barrel to center the apparatus.

6. The apparatus of claim 1, wherein the forward driving means comprises:

a plurality of wheels that are in contact with the inner surface of the gun barrel;

a forward movement motor providing power to the wheels; and a fastening part fastening the forward driving means to the end part of the press driving means.

7. The apparatus of claim 1, wherein the main shaft is composed of a large end part and a small end part having different diameters and screw threads formed on their outer surfaces, and the large part is connected to an output shaft of the motor to make a rectilineal movement in a direction of the main shaft.

8. The apparatus of claim 7, wherein the sticking means comprises:

a first flange coupled to the outer surface of the large end part;

a slide covering the outer surface of the first flange, bound by a rotation preventing pin, and having an edge part that forms an inclined surface; and an extender having an inner surface that forms a sloping surface corresponding to the inclined surface and extending to an outside to be stuck on the inner surface of the gun barrel as the slide is moved backward.

9. A combination comprising the apparatus of claim 1 and a dud.

10. An apparatus for removing a dud, provided with a forward driving means providing a propulsive force for forwarding the apparatus along an inner surface of a gun barrel, the apparatus comprising:

a press driving part directly connected to the forward driving means and having a built-in motor to provide a rotating force;

a sticking means connected to the press driving part and extended to an outside to be tightly stuck on the inner surface of the gun barrel by a main shaft being rotated by the motor; and a pushing part having one end part connected to the sticking means and the other end part coupled to a cap for contracting with the dud, and pushing the cap through a forward movement of the main shaft after the sticking on the inner surface of the gun barrel is performed by the sticking means, wherein the main shaft is composed of a large end part and a small end part having different diameters and screw threads formed on their outer surfaces, and the large part is connected to an output shaft of the motor to make a rectilineal movement in a direction of the main shaft.

11. The apparatus of claim 10, wherein the sticking means comprises:

a first flange coupled to the outer surface of the large end part;

a slide covering the outer surface of the first flange, bound by a rotation preventing pin, and having an edge part that forms an inclined surface; and an extender having an inner surface that forms a sloping surface corresponding to the inclined surface and extending to an outside to be stuck on the inner surface of the gun barrel as the slide is moved backward.

12. The apparatus of claim 11, wherein the rotation preventing pin has a coupling part that forms a long slot to which the first flange is coupled, whereby only the first flange is moved backward after the slide is moved backward for a predetermined distance and the extender is stuck on the inner surface of the gun barrel.

13. The apparatus of claim 12, wherein appearing and disappearing steel balls that are in contact with the slide are installed on one side of the outer surface of the first flange.

14. The apparatus of claim 11, wherein the extender is composed of upper and lower pads having connection surfaces that form square prominence and depression, and the lower pad is moved forward for one pitch of the square prominence and depression.

15. A combination comprising the apparatus of claim 10 and a dud.

* * * * *